US007303317B2

(12) United States Patent
Zanotti

(10) Patent No.: US 7,303,317 B2
(45) Date of Patent: Dec. 4, 2007

(54) DECORATIVE GLASS FOR LAMPS

(75) Inventor: Matteo Zanotti, Rimini (IT)

(73) Assignee: Interlighting Agency Dizanotti Matteo & C.S.N.C., Rimini (IT)

( * ) Notice: Subject to any disclaimer, the term of this patent is extended or adjusted under 35 U.S.C. 154(b) by 0 days.

(21) Appl. No.: 10/510,828

(22) PCT Filed: Jul. 29, 2002

(86) PCT No.: PCT/IT02/00501

§ 371 (c)(1),
(2), (4) Date: Oct. 28, 2004

(87) PCT Pub. No.: WO03/086993

PCT Pub. Date: Oct. 23, 2003

(65) Prior Publication Data

US 2005/0174783 A1 Aug. 11, 2005

(30) Foreign Application Priority Data

Apr. 12, 2002 (IT) ..... RN2002A0019

(51) Int. Cl.
*F21V 3/00* (2006.01)

(52) U.S. Cl. ..... 362/313; 362/311; 362/312

(58) Field of Classification Search ..... 362/311–314
See application file for complete search history.

(56) References Cited

U.S. PATENT DOCUMENTS

| | | | | |
|---|---|---|---|---|
| 3,849,640 | A * | 11/1974 | McCarthy | 362/437 |
| 4,074,165 | A | 2/1978 | Moriyama | |
| 4,256,989 | A * | 3/1981 | Trutner et al. | 313/318.01 |
| 4,845,602 | A * | 7/1989 | Lehocki | 362/122 |
| 5,743,634 | A | 4/1998 | Sitzema et al. | |
| 6,133,676 | A * | 10/2000 | Chen | 313/25 |
| 6,729,740 | B1 * | 5/2004 | Gazard | 362/100 |

FOREIGN PATENT DOCUMENTS

| | | |
|---|---|---|
| DE | 933 463 C | 9/1955 |
| DE | 297 23 340 U1 | 7/1998 |
| GB | 447 181 A | 5/1936 |

* cited by examiner

*Primary Examiner*—Laura Tso
(74) *Attorney, Agent, or Firm*—Browdy and Neimark, PLLC

(57) ABSTRACT

A decorative glass for lamps comprises a fastening device formed as a single body and able to allow direct association with a lamp holder. The fastening device preferably comprises a thread formed on the inner side of a surface portion of the glass.

10 Claims, 3 Drawing Sheets

DECORATIVE GLASS FOR LAMPS

TECHNICAL FIELD

The present invention relates to a decorative glass for lamps.

BACKGROUND ART

In the lighting technology sector it is very common to use decorative glass which, in addition to constituting an ornamental element influencing the aesthetic effect of the finished product, performs the dual function of ensuring improved diffusion of the light and protecting the light source which generally consists of a bulb.

Many of the bulbs which are currently available are associated with lamp holders; however, the possibility of directly associating lamp holder and decorative glass does not exist.

In fact, in the case where the glass has a thread, the latter is formed on a portion of their outer surface and, since the lamp holders may at best be also threaded externally, it becomes necessary to use an additional metal or plastic element which is machined internally and onto which the glass can be screwed or engaged in bayonet fashion. The limitation of this solution consists in the fact that complex processing of the glass must be performed using costly moulds and at high pressures in order to achieve optimum results. Moreover, the glass must have a fairly large thickness and this limits considerably the areas in which it may be used.

In other cases, the glass is supported by a spring which, after being forced into an opening formed in the surface, expands so as to exert a pressure on the walls of the opening. However, the firmer the fastening, the more difficult it will be to extract the spring from the opening; if, on the other hand, it is ensured that the spring can be extracted more easily, there is the risk that during use the spring may come out on its own. A very tight fastening furthermore may result in possible damage to the glass when removing the spring and generally this type of constructional solution worsens significantly the aesthetic effect of the assembly.

As an alternative, finally, the glass may be supported by a ring nut which can be screwed onto the lamp holder and which can be inserted inside the glass and perform its function making use of the weight of the glass, or can be glued thereto.

It is obvious, however, that the first possibility is not feasible whenever the glass has a closed, or at least a tapered shape, whereas the second possibility creates irregular reflections and shadows which are aesthetically unacceptable, in addition to not providing satisfactory guarantees as to strength.

DISCLOSURE OF THE INVENTION

The object of the present invention is therefore that of eliminating the above mentioned drawbacks. This is achieved by providing a direct connection between the decorative glass and lamp holder.

The main advantage obtained by means of the present invention consists essentially in the fact that the system of associating glass and lamp holder is simplified, the arrangement of components between them no longer being necessary: this results in a greater simplicity and rapidity of assembly, easier management of stocks and a lower cost of the finished product. In addition, where necessary, removal of the lamp holder from the glass is also much faster, without the risk of damage to the latter.

From an aesthetic point of view, it is possible to overcome any limitation associated with the shape and the glass elements may also be closed, in particular tapered, and have smaller thicknesses. Finally, the absence of adhesives on the one hand avoids irregular shadow effects which reduce the aesthetic appeal of the product and on the other hand eliminates the emission of toxic gases which can seriously damage the health of the operators.

BRIEF DESCRIPTION OF THE DRAWINGS

Further advantages and characteristic features of the invention will become clear from the detailed description which follows, with reference to the accompanying drawings, which show a non-limiting example of embodiment thereof in which.

DETAILED DESCRIPTION OF THE PREFERRED EMBODIMENTS

As can be seen from the figures, the present invention relates to a decorative glass for lamps; in addition to elements intended to distinguish it from an aesthetic point of view, and therefore extremely arbitrary and variable from one model to another, it comprises fastening means (2) which are formed as a single body and able to allow direct association with a lamp holder (P).

These fastening means (2) comprise a thread (2*a*) formed on the inner side of a surface portion (1*a*). Preferably, but not necessarily, the glass (1) comprises a fastening lug (1*b*) on which the abovementioned surface portion (1*a*) is located.

Figure 1:
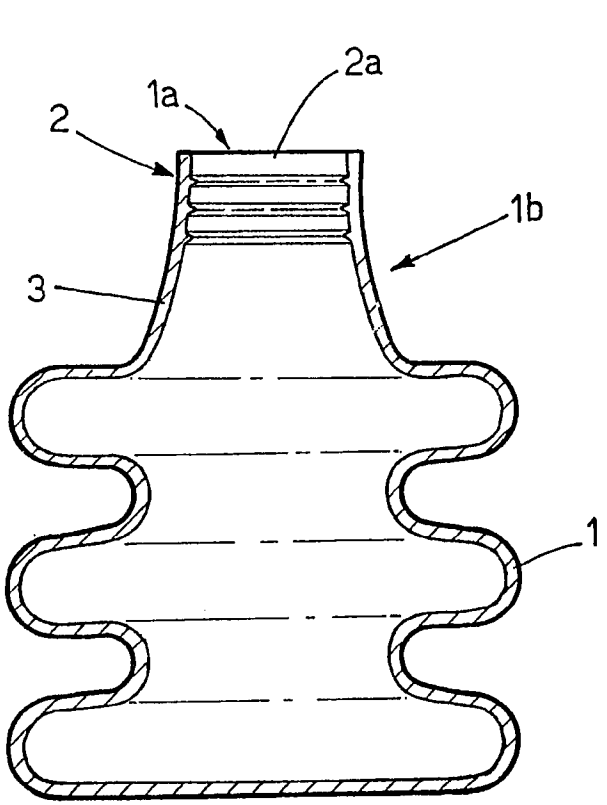
FIG. 1 shows a perspective view and a longitudinal section of a first embodiment of the invention.
Figure 1:
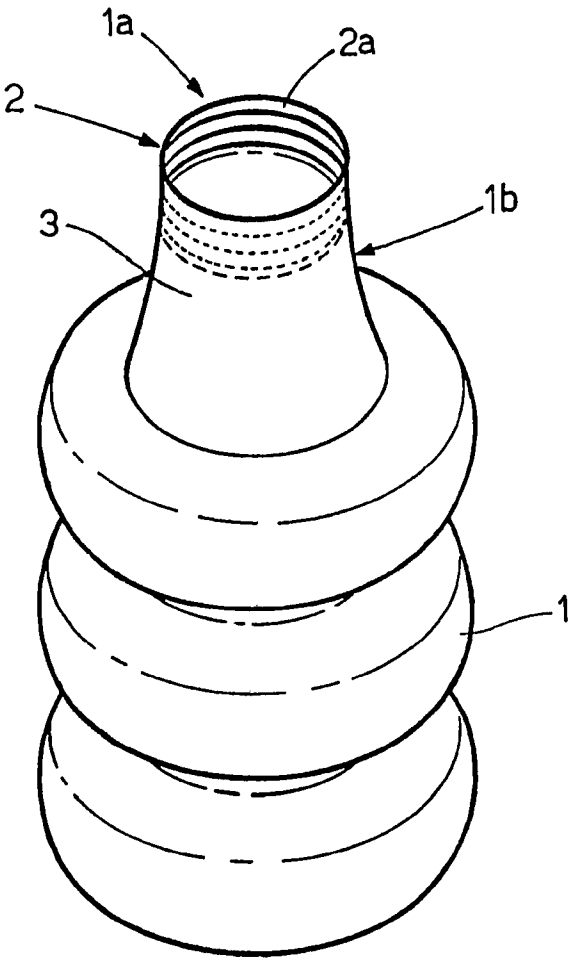
Figure 2:
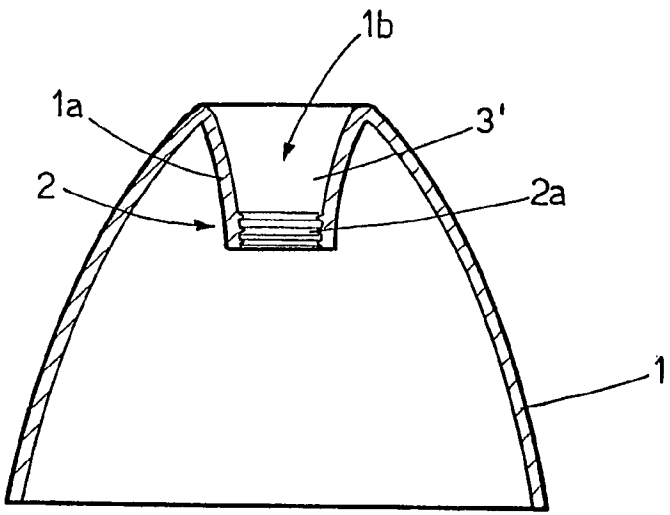
FIG. 2 shows a perspective view and a longitudinal section of a second embodiment of the invention.
Figure 2:
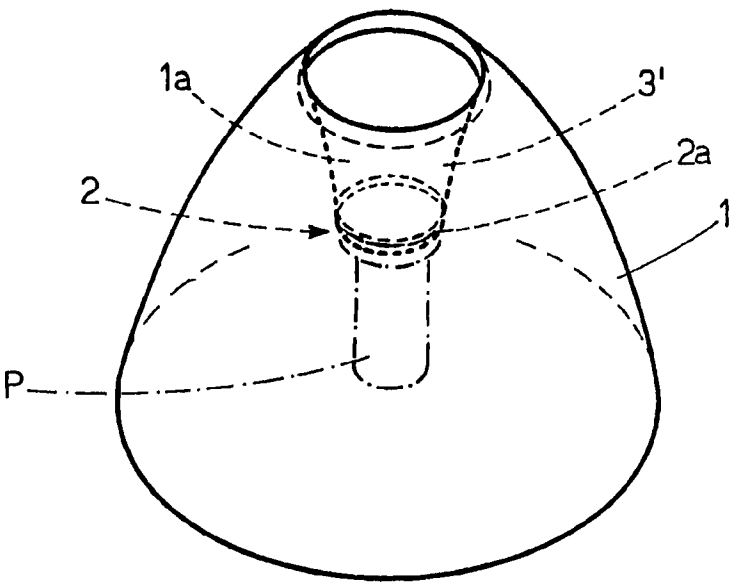
Figure 3:
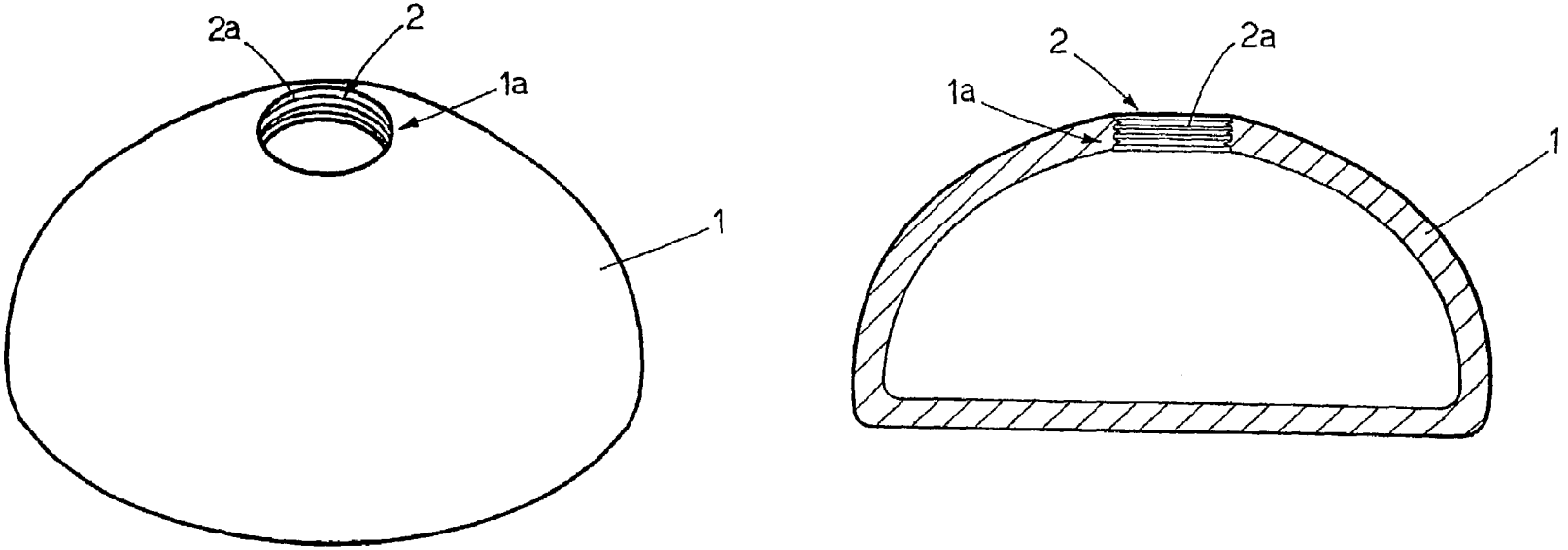
FIG. 3 shows a perspective view and a longitudinal section of a third embodiment of the invention.

For example, as has been shown in the figures, but not in a limiting manner, the lug (1*b*) may consist of a neck (3) outside of the volume of the main body of the glass (1), as can be seen in FIG. 1, or also of a neck (3') inside the volume of the main body of the glass (1), as can be seen in FIG. 2.

Since it is essential that the component used to manufacture this decorative glass (1) meets requirements suitable for ensuring indispensable aesthetic characteristics of the finished product, a particularly satisfactory solution has been obtained by using a borosilicate salt. The glass (1) which is obtained therefrom in fact results in processing which combines strength—allowing an internally threaded surface portion (1*a*) to be formed—and a thinness which does not adversely affect the transparency.

In addition, borosilicate is suitable for manual processing which can be performed using low-cost equipment and a traditional procedure; namely it can be worked at relatively low temperatures, while withstanding very high temperatures.

Although the description has been provided with reference to the use in the lighting technology sector, the invention is suitable for use in all those sectors where it may be advantageous, in order to limit the number of components, to use glass with an internal threading.

The invention thus conceived may be subject to numerous modifications and variations, all of which fall within the scope of the inventive idea. Moreover, all the details may be replaced by technically equivalent elements.

In practice, obviously modifications and/or improvements, nevertheless falling within the scope of the following claims, are possible.

The invention claimed is:

1. Decorative glass for lamps, comprising fastening means (2) formed in one piece with the glass in abutting engagement with a lamp holder (P), wherein said fastening means (2) comprise a thread (2*a*) formed on the inner side of a surface portion (1*a*) of the glass (1), wherein the glass includes a borosilicate salt to facilitate manufacture thereof.

2. Glass according to claim 1, wherein it comprises a fastening lug (1*b*) on which said surface portion (1*a*) is located.

3. Glass according to claim 2, wherein said lug (1*b*) consists of a neck (3) which extends out from the interior of the main body of the glass (1).

4. Glass according to claim 2, wherein said lug (1*b*) consists of a neck (3') which extends into the interior of the main body of the glass (1).

5. Decorative glass for lamps, said glass being a one-piece body having an integral portion defining fastening means (2) for directly associating said glass with a lamp holder (P), wherein said fastening means (2) comprise a thread (2*a*) formed on the inner side of a surface portion (1*a*) of the glass (1), wherein the glass includes a borosilicate salt to facilitate manufacture thereof.

6. A decorative glass on a lamp, comprising a glass main body;

a neck formed as a unit with the glass main body;

a thread formed integrally as part of an inner surface of said neck;

wherein said thread is in abutting engagement with an integral surface of the lamp.

7. The decorative glass as claimed in claim 6, wherein said neck extends away from the interior of the glass main body.

8. The decorative glass as claimed in claim 6, wherein said neck extends into the interior of the glass main body.

9. Decorative glass for lamps, comprising fastening means (2) formed in one piece with the glass in abutting engagement with a lamp holder (P), wherein said fastening means (2) comprise a thread (2*a*) formed on the inner side of a surface portion (1*a*) of the glass (1), wherein the glass includes a borosilicate salt to facilitate manufacture thereof;

wherein it comprises a fastening lug (1*b*) on which said surface portion (1*a*) is located; and wherein said lug (1*b*) consists of a neck (3') which extends into the interior of the main body of the glass (1).

10. A decorative glass on a lamp, comprising a glass main body;

a neck formed as a unit with the glass main body;

a thread formed integrally as part of an inner surface of said neck;

wherein said thread is an abutting engagement with an integral surface of the lamp; and wherein said neck extends into the interior of the glass main body.

* * * * *